United States Patent [19]

Grant

[11] 4,385,688

[45] May 31, 1983

[54] ARTICLE DISPLAY AND HOLDER APPARATUS

[76] Inventor: Robert F. Grant, 3234 South Cuyler Ave., Berwyn, Ill. 60402

[21] Appl. No.: 251,154

[22] Filed: Apr. 6, 1981

[51] Int. Cl.[3] ..... B65D 85/58

[52] U.S. Cl. ..... 206/0.83; 206/0.82; 206/0.84

[58] Field of Search ..... 206/0.82, 0.83, 0.84, 206/38; 229/65

[56] References Cited

U.S. PATENT DOCUMENTS

| | | | |
|---|---|---|---|
| 2,457,998 | 1/1949 | Hayes et al. . | |
| 2,571,073 | 10/1951 | Stroop | 206/0.83 |
| 2,597,227 | 5/1952 | Colliton . | |
| 3,100,567 | 8/1963 | Levy . | |
| 3,155,236 | 11/1964 | Reno . | |
| 3,193,090 | 7/1965 | Hudgeons, Sr. et al. . | |
| 3,302,773 | 2/1967 | Weir et al. . | |
| 3,500,995 | 3/1970 | Forman | 206/0.84 |
| 3,751,128 | 8/1973 | Skinner et al. . | |
| 3,809,217 | 5/1974 | Harrison . | |
| 3,837,475 | 9/1974 | Bolanz . | |

*Primary Examiner*—George E. Lowrance
*Assistant Examiner*—Jimmy G. Foster
*Attorney, Agent, or Firm*—Leonard J. Kalinowski

[57] ABSTRACT

A display and storage device for articles such as coins, medals, tokens and the like includes an envelope of a transparent material which is open-ended to receive an article, and a flat, sleeve-like member having a longitudinal slot therein, permitting the holder envelope with an article contained therein to be slipped into the sleeve member, an inner edge of the slot being tapered to compress and close the open end of the envelope thereby formng a generally airtight enclosure of the article, and the sleeve member having a central aperture for enhancing viewability of the article. A plurality of the storage device may be mounted on an apertured display board.

13 Claims, 12 Drawing Figures

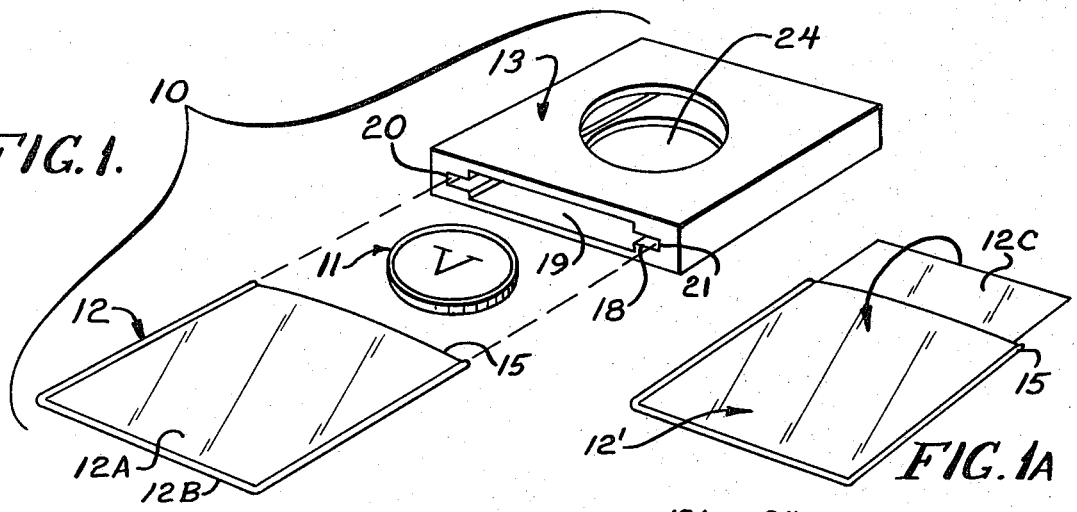
FIG. 1.
10
13
24
20
11
19
21
18
12
15
12A
12B
12C
12'
15
FIG. 1A
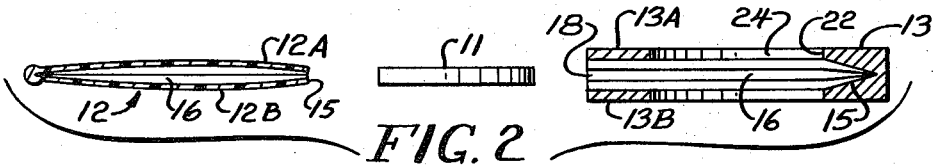
12A
12
16
12B
15
11
18
13A
24
22
13
13B
16
15
FIG. 2
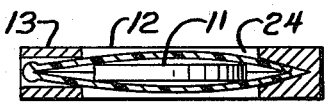
13
12
11
24
FIG. 3
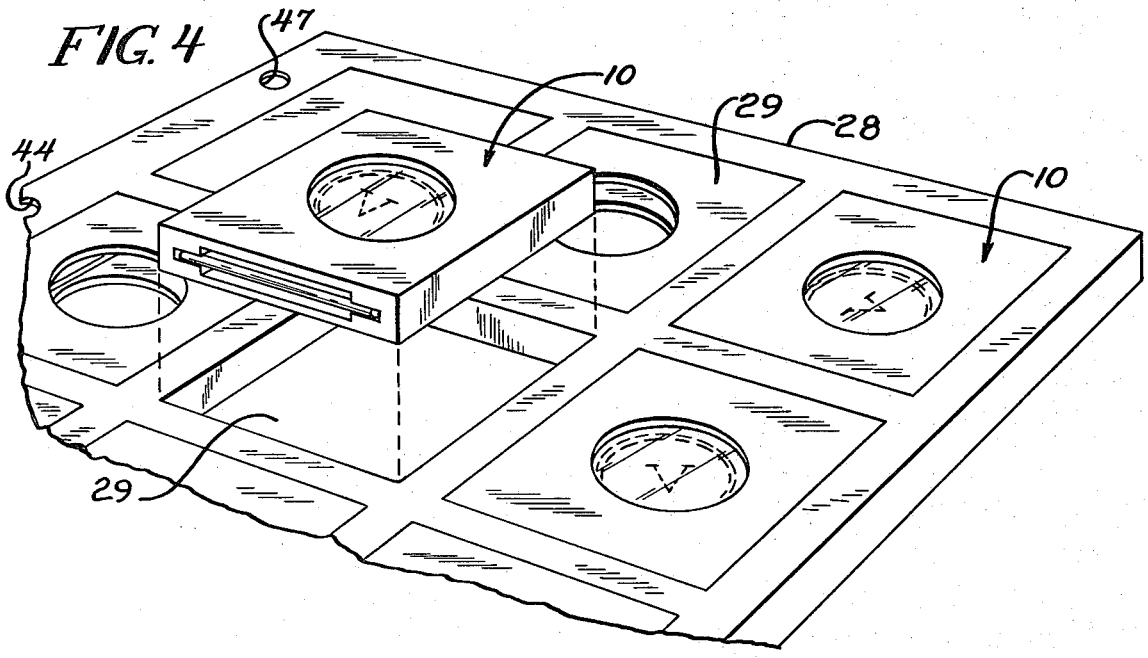
FIG. 4
47
10
29
28
44
10
29
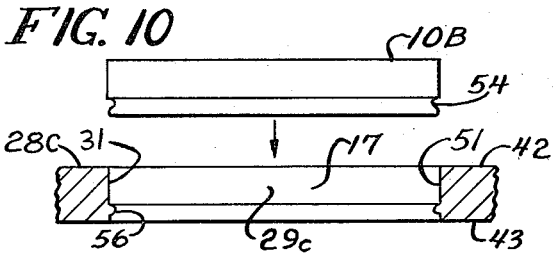
FIG. 10
10B
54
28C
31
17
51
42
56
29c
43
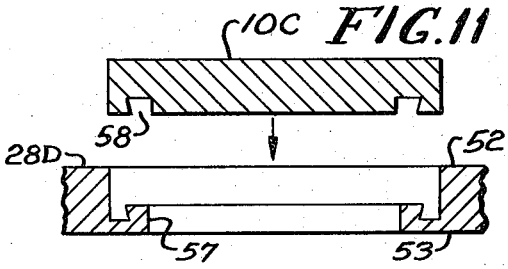
10C
FIG. 11
58
28D
52
57
53

ARTICLE DISPLAY AND HOLDER APPARATUS

BACKGROUND OF THE INVENTION

1. Field of the Invention

This invention relates to article display and storage devices, and more particularly to a two-piece storage device adapted to receive a small article, such as a coin, a medal, a token or the like, and provide a generally air-tight enclosure for enclosing the article.

2. Description of the Prior Art

Various display devices have been proposed for storing articles, such as coins, tokens, medals, stamps, and the like which comprise a collection of such articles. For example, in coin collecting, one of the most widely used coin holders is the Whitman holder which comprises a heavy paper or cardboard booklet having a plurality of leaves each of which comprises a heavy pressed paper page, which is apertured to permit display of both sides of the coins. The coins are held in place by plastic sleeves which are inserted between the board and an attached paper lamination.

It is known that coins stored in such storage devices are subject to tarnish from prolonged contact with the paper which comprises the leaves of the album. In addition, the plastic sleeve does not provide an airtight seal for the coins, and accordingly, the coins are subject to tarnish from contaminents in the air.

Other known display and storage devices provide a transparent holder to encapsulate the coins to minimize tarnishing of the coins from contaminants in the air. A popular coin holder in use consists of a plastic coin board sandwiched by two transparent sheets which are fastened together by screws. This type of holder requires complete disassembly to add or remove a single coin, which is time consuming and exposes all of the other coins on the board to damage from handling.

Another article storage device, which is particularly adapted to mounting a coin on a mounting board, includes two flanged cup members which are received in a recess formed in the mounting board and which are held together by a friction type lock provided by interlocking peripheral beads formed on the outer wall of one cup member and the inner wall of the other cup member. A coin is added to the mounting board by placing the coin in a recess in one of the cup members and then inserting the mating cup members into an aperture of the board from opposite sides of the board and pressing the cup members together to lock the two cup members in place. However, to remove a coin from the board, the cup members must be pried apart to disengage the locking bead members before the two cup members can be separated, permitting the coin to be removed. Also, the coin may be subjected to damage from handling when it is added to or removed from the mounting board, and repeated use of the holder may result in wearing or breakage of the interlocking bead members, which would prevent the establishment of a suitable friction lock for the mating cup members.

A further known coin display apparatus employs a mounting board having a plurality of threaded recesses for receiving coins and a plurality of threaded cover members which are screwed into the recesses to enclose the coins and secure the coins to the board. To add a coin to the board, a threaded cover member is removed from the board, and the coin is placed in the corresponding recess. The threaded cover member is then screwed into the recess to enclose the coin. To remove a coin from the board, the threaded cover is unscrewed, exposing the coin which then can be lifted out of the recess in the board. However, this arrangement only provides for mounting of a plurality of coins and the coins are exposed to tarnishing or other damage in adding a coin to the mounting board or removing the coin from the mounting board.

Therefore, it would be desirable to have an article display and storage device for enclosing an article, such as a coin, a medal, a token or the like, and which is simple to use and durable in construction. It would also be desirable to have a display and storage device which facilitates the addition or removal of an article to a display board without subjecting the article to damage from handling or exposure to the atmosphere.

SUMMARY OF THE INVENTION

The present invention provides a display and storage device for an article which provides a substantially airtight container for the article and which permits an individual article to be mounted on or removed from a display board quickly and without subjecting the article, or other articles mounted on the same display board, to damage as may result from handling and also, exposure to the atmosphere.

In accordance with the invention, the display and storage device comprises a flat, generally rectangular container having upper and lower members sealed along three edges and having an open end defined by fourth edges, permitting an article to be received and contained within said container, and a receptacle having upper and lower panels each having a recessed center portion, the recessed portions being alinged with one another defining a compartment for receiving the container with an article contained therewithin. The receptacle has container closing means which cooperates with the fourth edges of the container, urging them together to close the open end of the container when it is located within the receptacle.

The receptacle comprises a sleeve-like member with its inner compartment being communicated with the exterior of the receptacle, defining a longitudinal slot permitting the envelope, with an article container therein, to be slipped into the sleeve member and positioned within its compartment. An inner wall of the slot of the sleeve member is tapered, defining the container closing means. The tapered wall serves to compress and close the open end of the envelope, as the envelope is inserted into the sleeve, thereby forming a generally airtight enclosure for the article. The upper and lower panels of the sleeve member are apertured exposing both faces of the article enclosed within the envelope thereby enhancing the viewability of the article. The presence of the aperture also facilitates removal of the envelope from the sleeve, while the article remains contained within the envelope. The container is removable from the sleeve by simply pushing the encased article back through the aperture.

In accordance with another aspect of the invention, the storage assemblies are mounted on an apertured display or mounting board. In one mounting arrangement, each storage assembly is received in an aperture of the board and is maintained in the aperture by means of flexible flanges. In another embodiment, the storage assembly is maintained in an aperture of the board by way of a friction fit. In a further embodiment, two sides of the sleeve member have grooves which mate with ribs framed on sidewall surfaces of the mounting board apertures for securing each storage assembly to the board.

DESCRIPTION OF THE DRAWINGS

FIG. 1 is an exploded perspective view of the embodiment for an article storage device provided by the present invention;

FIG. 1A is a perspective view of an embodiment of a container member of the storage device;

FIG. 2 is a side sectional view of the article storage device of FIG. 1, shown unassembled;

FIG. 3 is a side sectional view of the article storage assembly of FIG. 1 shown assembled.

FIG. 4 is a perspective view of a display assembly illustrating a portion of a display board and a plurality of article storage devices of the type shown in FIG. 1;

FIGS. 10 and 11 show further arrangements for mounting storage devices on a display board.

DESCRIPTION OF PREFERRED EMBODIMENTS

Figure 5:
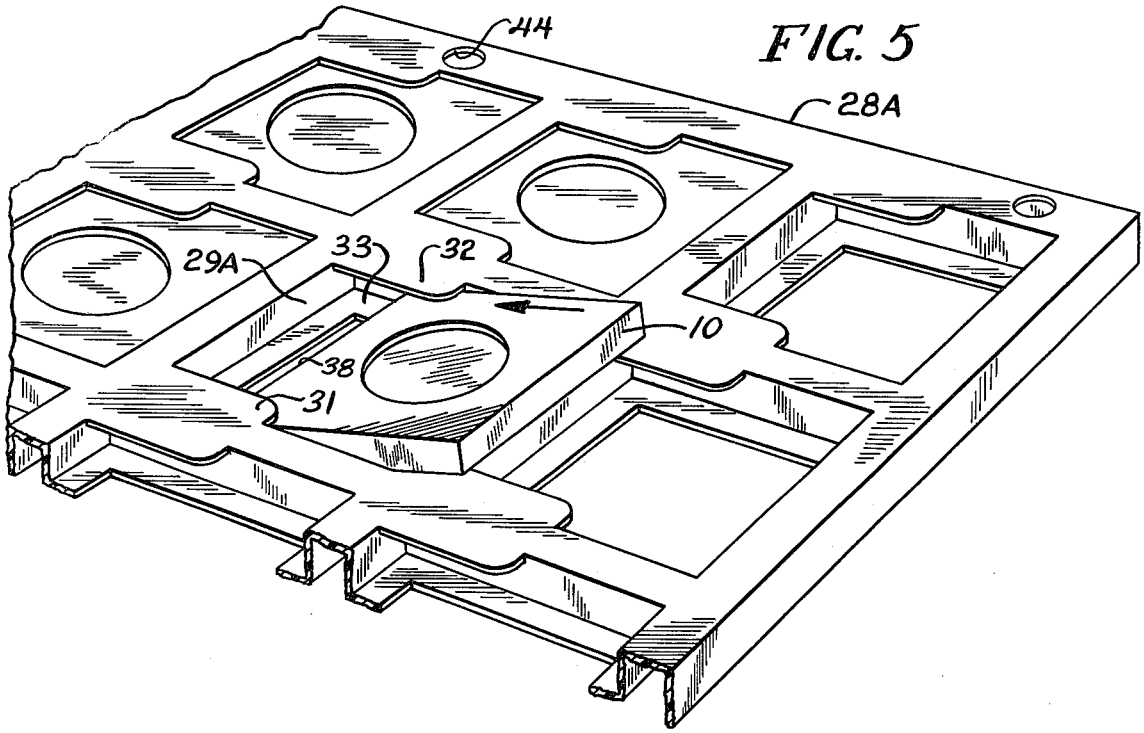
FIG. 5 is a perspective view of another embodiment of a display assembly illustrating a portion of a display board for mounting a plurality of article storage devices.

Referring to the drawings, FIG. 1 is an exploded perspective view of one embodiment for an article storage device 10 provided by the present invention. The article storage device 10 may be used to store a disc-type article 11, such as a coin, a medal, a token or the like. The article storage device 10 includes a transparent, flexible envelope or container 12 sealed on three sides which mates with sleeve member 13 providing a substantially airtight capsule for enclosing the article 11 in manner to be shown.

More specifically, the envelope 12 comprises two sheets 12A or 12B of a flexible, transparent material, such as Mylar. The sheets are sealed together on three edges the fourth edge 15 being open-ended defining a compartment 16, shown best in FIG. 2, in which the article 11 is received.

Referring to FIGS. 1 and 2, the sleeve member 13, which is generally rectangular in shape, is made of a rigid material, such as plastic, and may be formed, for example by molding. The sleeve member 13 has an opening in the form of a slot on one side 18 which extends longitudinally through the member 13.

Referring to FIGS. 1 and 2, the receptacle or sleeve member 13, which is generally rectangular in shape, is made of a rigid material, such as plastic, and may be formed, for example, by injection molding. The sleeve member has upper and lower panels 13A and 13B which may be formed separately and joined or connected together, or may be molded as an integral structure as illustrated. The sleeve member 13 has a slot terminating at one side 18 and extending longitudinally through the member 13. An aperture 24 defines recessed center portions of the two panels 13A and 13B.

As shown best in FIG. 1 the center portion 19 of the slot is wide enough to enable the article contained in the envelope to be received in the slot. The end portions 20 and 21 of the slot which receive the ends of the envelope, are narrower than the center portion, to guide the edges of the envelope 12 as it is slipped into the sleeve member.

Referring to FIG. 2, the inner rear surface 22 of the sleeve member, which receives the open end 15 of the envelope as it is slipped into the sleeve, is tapered to compress the edge 15 of the envelope thereby closing its open end, forming a substantially airtight compartment when the envelope is positioned with the sleeve as illustrated in FIG. 3.

Referring to FIG. 1A, in another embodiment, the envelope 12 has a flap 12C extending from its open edge 15, the flap being foldable, as indicated by the arrow, to close the open end 15 after the article has been inserted. The flap 12C is compressed against the main body portion of the container 12 by the tapered edge 22 of the sleeve member when the container is inserted into the sleeve member.

When the storage device 10 is assembled as shown in FIG. 3, the article is located within the aperture 24 of the sleeve member 13, providing viewing windows which permit the article to be viewed from either side.

The storage device 10 may be provided in a number of basic sizes to store articles of different diameters such as coins of different denominations. Various size apertures 24, may be provided to adapt a sleeve 13 of a given size to an odd size article. The article is positioned within the compartment 16 of the envelope member 12, and the envelope member 12 and the article 11, thus assembled together, are placed in the sleeve member 13. The aperture 24 of the sleeve member 13 enables the article 11, while contained within the envelope 12, to be pushed back through the aperture, facilitating the removal of the enclosed object from the holder.

The storage device 10 provides for storage of a single article 11, and also permits the enclosed article to be mounted on a suitable mounting or display board, such as mounting board 28 shown in FIG. 4, along with a plurality of similar article storing devices to provide a unitary display assembly for a plurality of articles. The mounting board 28 may be of a rigid material such a plastic, metal, or wood. Alternatively, the mounting board may be a transparent material, such as acrylic. The mounting board 28 is generally rectangular in shape and has a plurality of apertures 29 for receiving a like plurality of the storage devices 10. In one embodiment, the inner dimensions of each aperture 29 correspond to the outer dimensions of the assembly 10 of a given size providing a friction fit. Different mounting boards, each having apertures of given dimensions may be provided to accommodate the different groupings for the storage devices 10. Alternatively, a given mounting board may have apertures of different dimensions for displaying articles of different sizes.

Figure 6:
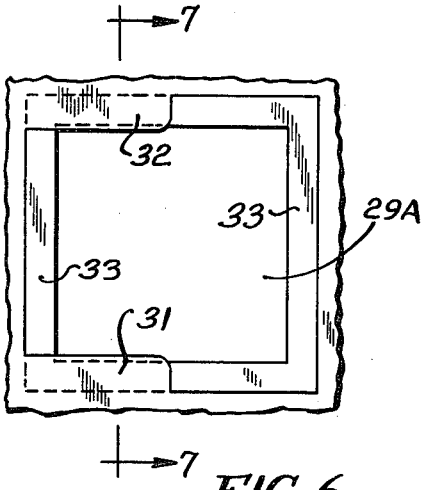
FIG. 6 is a plan view illustrating one of the mounting apertures of the display board of FIG. 5.
Figure 7:
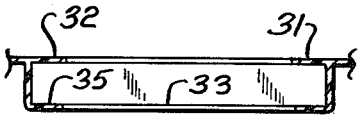
FIG. 7 is a sectional view taken along lines 7—7 of FIG. 6.

Another arrangement for mounting a plurality of storage devices on a display board is illustrated in FIG. 5. In this embodiment, the mounting board 28A is of a flexible plastic material, which may be transparent or opaque, and has a pair of flexible flanges at opposite edges of each aperture, such as flanges 31 and 32 for aperture 29A for retaining the storage device 10 on the board. The flanges 31 and 32 each comprise a generally rectangular strip which is integrally formed with the aperture defining edges of the board and located at the top surface of the board to overlie the upper surface of the storage device 10. As best shown in FIGS. 6 and 7, a peripheral shoulder 33, located at the bottom surface of the board and extending inwardly into the aperture 29A provides a support for the bottom edge of the storage device 10 as well as defining an open bottom to expose to view the underside of the device. This distance between the lower surface of the flanges 31 and 32 and the upper surface 35 of the shoulder 33 corresponds to the height or thickness of the storage device 10.

Referring again to FIG. 5, to mount a storage device on the display board 28A, the storage device 10 is tilted and positioned with a leading edge 38 located between the flanges 31, 32 and the shoulder 33 as shown in FIG. 5. The device 10 is then moved in the direction of the arrow while its leading edge 38 is rotated downwardly. The flanges 31 and 32 will flex upwardly, somewhat as the storage device is slipped into place with its bottom edge surface resting on shoulder 33 and its upper surface beneath flanges 31 and 32. Removal of the storage device from the mounting board 28A is effected by applying thumb pressure to the underside of the device near the edge opposite that which is located beneath the flanges.

Figure 8:
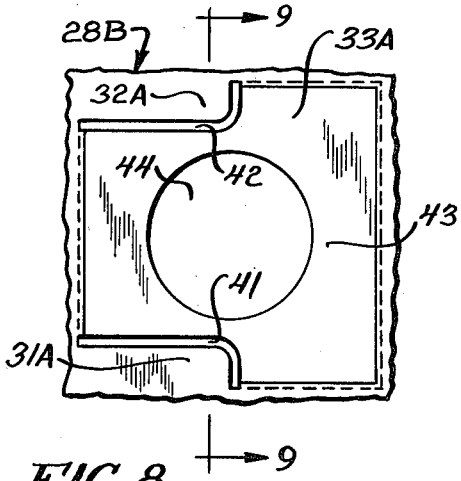
FIG. 8 is a plan view illustrating mounting apertures of an alternative embodiment for a mounting board.
Figure 9:
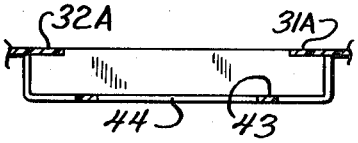
FIG. 9 is a sectional view taken along lines 9—9 of FIG. 8.

The mounting board 28A may be made using injecting molding techniques. Alternatively, with reference to FIGS. 8 and 9, there is shown an embodiment for a mounting board 28B which is similar to mounting board 28A shown in FIG. 5 in that it has flexible flanges 31A and 32A and a support shoulder 33A. However, mounting board 28B is made from a solid sheet of a flexible plastic material which is stamped and formed by a heat press to define the central aperture and the flanges. Slots, or cutouts, 41 and 42 are formed where the flanges 31A and 32A are severed from the bottom 43. A circular aperture 44 is provided in the bottom 43 to expose the underside of the storage device to when it is mounted on the board 28B.

In another embodiment, the outer edge of the storage device 10B, shown in FIG. 10, is provided with a groove 54 to provide an interference fit between the outer edge of the storage device 10B and ribs 56 formed on the inner surface 51 of the aperture 29C of the mounting board 28C.

In the embodiment shown in FIG. 11, mounting board 28D is provided with an L-shaped extension 57 having an inverse tapered portion which mates with an inverse tapered slot 58 formed in the bottom of the storage device 10C to secure the device 10C to the board 28D. The height of the storage device 10C corresponds to the thickness of the mounting board 28D to provide a flush fit relative to the upper and lower surfaces 52 and 53 of the mounting board 28D.

In accordance with the invention, the article stored by each of the storage devices 10 may be added to or removed from any one of the mounting boards while enclosed by the storage device 10 such that the article is not subjected to tarnishing or other damage through handling or exposure to the atmosphere.

The mounting boards may have a plurality of mounting holes 44 disposed along a peripheral edge to permit a plurality of mounting boards to be assembled into a loose-leaf display book. Suitable front and back covers may be provided for such assembly, if desired.

I claim:

1. A display and storage device for an article, comprising: a flat container of a transparent material, said container being generally rectangular in shape and having upper and lower members joined together along three edges thereof and said container having an open end defined by fourth edges of said upper and lower members, permitting an article to be received and contained within said container, and a receptacle having upper and lower panels each having a recessed center portion, the recessed portions of said panels being aligned with one another defining a compartment for receiving said container with an article contained therewithin, opposing peripheral edges of the recessed portions of the panels having cutaway portions which define a channel for receiving the edges of said container, and the walls of at least the cutaway portion of the channel which receives the fourth edges of said container being tapered defining container closing means which cooperates with the fourth edges of said upper and lower members of said container, to urge said fourth edges of said upper and lower members together when the container is located within the compartment of said sleeve member, thereby closing the open end of said container.

2. A device according to claim 1 wherein said receptacle has an opening in one side thereof communicating said compartment with the exterior of said receptacle to permit the insertion of said container into the compartment of said receptacle.

3. A display and storage device for an article, comprising: a flat container of a transparent material, said container being generally rectangular in shape and having upper and lower members joined together along three edges thereof and said container having an open end defined by fourth edges of said upper and lower members for permitting an article to be received and contained within said container, and a sleeve member having a slot extending longitudinally thereof for receiving said container, the slot of said sleeve member having edge portions which are of a first width which corresponds to the thickness of the edges of said container, defining guide channels for at least first and second edges of said container, the portion of said slot intermediate its edge portions being of a second, greater width corresponding generally to the thickness of the article, to facilitate the insertion of the container, with the article container therewith, into the sleeve member, said sleeve member being generally rectangular in shape and having upper and lower panels spaced apart from one another by first and second sidewalls, defining said slot, and a rearward wall closing one end of the sleeve member, said rearward wall having a tapered groove formed in its inner surface, defining container closing means which cooperates with the fourth edges of said upper and lower members to urge said fourth edges of said upper and lower members together as the container is inserted into said sleeve member thereby closing the open end of said container.

4. A device as set forth in claim 3 wherein the fourth edge of one of said container members defines a flap which is foldable onto the fourth edge of said other container member.

5. A device as set forth in claim 3 wherein said sleeve member has an aperture formed through its upper and lower panels, said article being aligned with said aperture to enhance the viewability of the article when said container is positioned within said sleeve member and to facilitate extraction of the container from the sleeve member.

6. A device as set forth in claim 3 wherein said container is comprised of a flexible material and said sleeve member is comprised of a rigid material.

7. A display and storage device for an article comprising: a flat, flexible container of a transparent material, said container being generally rectangular in shape and having upper and lower members joined together along three edges thereof and said container having an open end defined by fourth edges of said upper and lower members to permit an article to be received and contained within said container, and a sleeve member having upper and lower panels, first and second sidewalls spacing said panels apart from one another defining a slot which extends longitudinally of said sleeve member, and a rearward wall enclosing one end of the sleeve member, said rearward wall having a tapered groove formed in its inner surface which cooperates with the fourth edges of said upper and lower members of said container, to urge said fourth edges of said upper and lower members together as the container is inserted into said sleeve member and said fourth edges engage the groove in said rearward wall, thereby closing the open end of said container.

8. A device as set forth in claim 7 wherein said first and second sidewalls each have a groove formed therein which is of a width which corresponds to the thickness of the edges of the container for receiving and guiding side edges of said container as it is inserted into said sleeve member, each of said grooves in said sidewalls extending from the open end of the sleeve member to its rearward wall and terminating in juxtaposition with the groove formed in said rearward wall whereby said fourth edges of said container are guided into the groove in the rearward wall as the container is inserted into said sleeve member.

9. In a display assembly for at least one article, the combination comprising:

a flat container of a transparent material, said container being generally rectangular in shape and having upper and lower members joined together along three edges thereof and said container having an open end defined by fourth edges of said upper and lower members to permit an article to be received and contained within said container, a sleeve member having a slot extending longitudinally thereof for receiving said container, said sleeve member having container closing means which cooperates with the fourth edges of said upper and lower members, as the container is inserted into said sleeve member, to urge said fourth edges of said upper and lower members together thereby closing the open end of said container, and a mounting board having upper and lower surfaces with at least one aperture extending through said board from its upper surface to its lower surface, for receiving said sleeve member and containing said sleeve member therewithin, said mounting board having a shoulder portion located near its lower surface and extending into said aperture for supporting the bottom edge of said sleeve member when it is positioned within said aperture, and said mounting board having at least first and second flange portions of a flexible material, located near its upper surface and engaging the upper surface of said sleeve member when it is positioned within said aperture, for securing said sleeve member to said mounting board.

10. A display assembly as set forth in claim 9 wherein the slot of said sleeve member has edge portions which are of a first width which corresponds to the thickness of the edges of said container, defining guide channels for at least first and second edges of said container, the portion of said slot intermediate its edge portions being of a second, greater width corresponding generally to the thickness of the article, to facilitate the insertion of the container, with the article container therewithin, into the sleeve member.

11. A display assembly as set forth in claim 9 wherein the sleeve member is generally rectangular in shape and has upper and lower panels spaced apart from one another by first and second sidewalls, defining a slot, and a rearward wall closing one end of the sleeve member, said rearward wall having a tapered groove formed in its inner surface, defining said container closing means.

12. In a display assembly for at least one article, the combination comprising:

a flat container of a transparent material, said container being generally rectangular in shape and having upper and lower members joined together along three edges thereof and said container having an open end defined by fourth edges of said upper and lower members to permit an article to be received and contained within said container, a sleeve member having a slot extending longitudinally thereof for receiving said container, said sleeve member having container closing means which cooperates with the fourth edges of said upper and lower members, as the container is inserted into said sleeve member, to urge said fourth edges of said upper and lower members together thereby closing the open end of said container, and a mounting board having upper and lower surfaces with at least one aperture extending through said board from its upper surface to its lower surface, for receiving said sleeve member and containing said sleeve member therewithin, said mounting board having an extension formed along at least a portion of the inner surface of said aperture, and said sleeve member having a groove formed along at least a portion of its outer periphery which receives at least a portion of said extension when the sleeve member is positioned within said aperture.

13. In a display assembly for at least one article, the combination comprising: a flat container of a transparent material, said container being generally rectangular in shape and having upper and lower members, said container having at least one open end defined by first edges of said upper and lower members to permit an article to be received and contained within said container; a receptacle having upper and lower panels each having a recessed center portion, the recessed portions of said panels being aligned with one another defining a compartment for receiving said container, said receptacle having container closing means which cooperates with at least said first edges of said upper and lower members to urge said first edges of said upper and lower members together thereby closing the open end of said container; and, a mounting board having upper and lower surfaces with at least one aperture extending through said board from its upper surface to its lower surface for receiving said receptacle and containing said receptacle therewithin, said mounting board having a shoulder portion located near its lower surface and extending into said aperture for supporting the bottom edge of said receptacle when it is positioned within said aperture, and said mounting board having at least one flange portion of a flexible material located near its upper surface and projecting into engagement with the upper surface of said receptacle when said receptacle is positioned within said aperture, for securing said receptacle to said mounting board.

* * * * *